US006107928A

United States Patent [19]

Gatti

[11] Patent Number: 6,107,928

[45] Date of Patent: Aug. 22, 2000

[54] DEVICES FOR SENSING THE PRESENCE OF AN OBJECT IN A STORAGE COMPARTMENT, PARTICULARLY A MINIBAR, AND REMOTE DATA COLLECTION SYSTEM THEREFOR

[75] Inventor: Georges René Gatti, Cormeilles en Parisis, France

[73] Assignee: BEC Etudes Commercialisations, Chartres, France

[21] Appl. No.: 09/051,398

[22] PCT Filed: Oct. 16, 1998

[86] PCT No.: PCT/FR96/01612

§ 371 Date: Apr. 10, 1998

§ 102(e) Date: Apr. 10, 1998

[87] PCT Pub. No.: WO97/14335

PCT Pub. Date: Apr. 24, 1997

[30] Foreign Application Priority Data

Oct. 17, 1995 [FR] France ..... 95 12615

[51] Int. Cl.[7] ..... G08B 21/00

[52] U.S. Cl. ..... 340/686.1; 340/568.1; 340/999

[58] Field of Search ..... 340/999, 686.1, 340/686.6, 562, 568.1

[56] References Cited

U.S. PATENT DOCUMENTS

| | | | |
|---|---|---|---|
| 4,293,852 | 10/1981 | Rogers . | |
| 4,573,041 | 2/1986 | Kitagawa et al. . | |
| 4,810,957 | 3/1989 | Rubbmark et al. | 340/568 |
| 4,891,755 | 1/1990 | Asher | 364/406 |

FOREIGN PATENT DOCUMENTS 42 40 623 7/1994 Germany .

*Primary Examiner*—Edward Lefkowitz
*Attorney, Agent, or Firm*—Young & Thompson

[57] ABSTRACT

A device (1, 100) for sensing the presence of an object in a storage compartment (40), particularly a minibar. The device (1, 100) includes a set of capacitive sensing modules (3) each comprising two electrodes (5, 6) adjacent to a holder for an object (46), and an oscillating circuit including the capacitance between the electrodes (5, 6). The device (1, 100) further includes electronic processing which interacts with each capacitive sensing module in order to output sensing signals indicating the presence or absence of objects on each holder, and to provide a capacitive signature of the objects. The device is useful in storage equipment, particularly in hotels.

24 Claims, 3 Drawing Sheets

FIG_1A
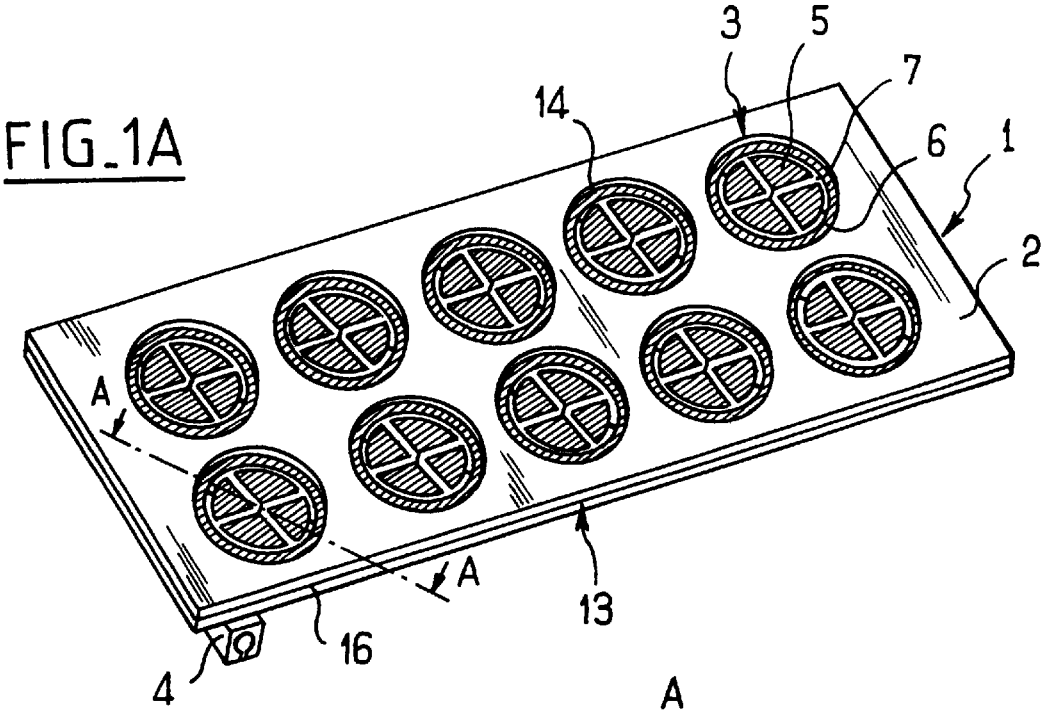
FIG_1B
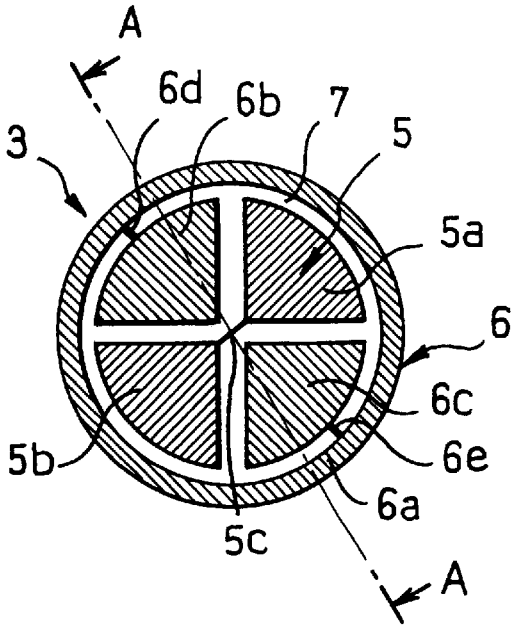
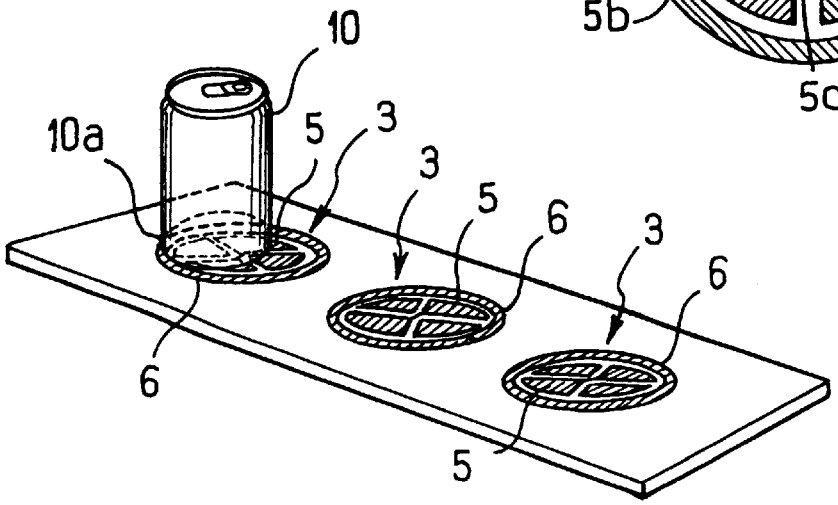
FIG_1C

DEVICES FOR SENSING THE PRESENCE OF AN OBJECT IN A STORAGE COMPARTMENT, PARTICULARLY A MINIBAR, AND REMOTE DATA COLLECTION SYSTEM THEREFOR

BACKGROUND OF THE INVENTION

The present invention relates to devices for sensing the presence of an object in a storage compartment, in particular a minibar. It also relates to a system for the remote collection of data originating from these sensor devices.

Hotel operators are particularly aware of the growing problems linked to the management of minibar installations. They encounter both difficulties in correctly invoicing consumption which is often based on erroneous consumption data supplied by the clients themselves at the end of their stay or collected by staff, and difficulties in efficiently managing the daily restocking of these minibars. Furthermore, they wish to be able to vary the price of the articles consumed in the minibar according to the type of client and particular events.

Systems for sensing objects intended for minibar management using presence sensors are already known for example by Patent DE-A-42 40 623.

There are also known models of minibars equipped with object presence sensors using feelers, which have the drawback however of being sensitive to impact and containing mechanical parts to form the contacts which may deteriorate over time. There are also infrared sensor devices which have the drawback of having a sensory response which is sometimes sensitive to the external characteristics of the object to be detected, in particular its color and packaging, and of implementing links by optical fibers which over time entail connection reliability problems.

Current devices have the common drawback of only providing information on the object's presence or absence, and do not therefore allow a truly quantitative and qualitative management of storage compartments and in particular minibars.

SUMMARY OF THE INVENTION

The purpose of the invention is to overcome these drawbacks by offering a device for sensing the presence of objects in a storage compartment, in particular a minibar, which provides more information than just the presence or absence of the object, while being more solid, less sensitive to the external environment and cheaper than other sensor devices currently on offer.

This device for sensing the presence of an object in a storage compartment comprises a set of capacitive sensor modules each comprising two electrodes located close to a support intended to house an object and an oscillating circuit including the capacitance between these two electrodes, these electronic processing means co-operating with each capacitive sensor module to output sensor signals indicating the presence or absence of objects on each of the said supports.

According to the invention, the electronic processing means also cooperate with each capacitive sensor module in order to supply a capacitive signature of the objects present in the storage compartment.

Thus, thanks to the sensing of the capacitive signature of objects present in the storage compartment, it becomes possible to determine their identification in addition to their presence, thus contributing to better stock management. It should be noted that the notion of capacitive signature encompasses any information and measurement linked to an object's capacitive behavior, whether in a steady state (different capacitances measured in the presence or the absence of an object) or in a dynamic state (capacitance variation laws on removal or replacement of an object).

In particular, it can advantageously be envisaged for the capacitive signature of an object present in the storage compartment to include information indicating a modification of said object's geometric and/or volumetric characteristics.

In a preferred implementation of a sensor device according to the invention, the two electrodes of each capacitive sensor module have a geometry designed to keep a limited and approximately linear variation of the capacitance detected when an object is moved with respect to said capacitive sensor module. Furthermore, this geometry allows the sensing of objects of varying size, in particular objects having a smaller contact surface than the support surface of the capacitive modules.

In particular, a configuration can be envisaged in is which each capacitive sensor module comprises:

- a first electrode comprising an external conductive ring and, inside this ring, at least a first and a third conductive internal sector connected electrically to said external conductive ring, and
- a second electrode comprising, inside said external conductive ring, a second and fourth conductive internal sector electrically connected to each other.

Moreover, the capacitive sensor modules and the electronic processing means are preferably included in a watertight structure comprising connection means intended for co-operation with external connection means for the purpose of transmitting the sensor signals.

This implementation allows easy cleaning of the sensor devices which are generally subjected to frequent liquid soiling.

In a first form of implementation corresponding to the case of storage of bottles and cylindrical containers of the can type, the sensor device also comprises on its upper surface recesses shaped as supports for housing objects.

It is advantageously envisaged that a thin insulating layer should be arranged between the electrodes and the bottom of the recesses. This insulating layer is naturally present when the capacitive sensor modules are included in a watertight structure made for example of resin.

Usually, these recesses are in an approximately cylindrical shape, but they could in fact be of any shape adapted to the particular shapes of an object, for example square or more generally polygonal or also elliptical or oblong.

In a preferred implementation of the present invention, a sensor device is arranged in the form of a removable watertight tray intended to be inserted in the place of a shelf in a refrigerator, in particular a minibar.

This form of implementation has the advantage of being suitable for equipping existing refrigerators, and in particular minibars, by allowing existing shelves located in the main part of the refrigerator to be replaced with these trays.

In this case, the connection means are arranged on a rear portion of this tray in such a manner that, when said tray is inserted, these connection means come into contact with external connection means arranged appropriately at the back of the refrigerator.

In a second form of implementation, corresponding to equipment fitting inside the doors of refrigerators and in particular minibars, the sensor device according to the invention is intended to be arranged against an internal surface of a support for objects containing several compartments, each capacitive sensor module being associated with one compartment.

A sensor device can however also be envisaged in a form allowing it to house an object directly on its upper surface, with an insulating layer arranged between the electrodes of each capacitive module and said upper surface.

The electronic processing means can be produced based on known techniques and can advantageously incorporate an ASIC circuit for the processing and packaging of signals originating from the capacitive modules. Moreover, it can advantageously be envisaged that the electronic processing means be arranged to apply fuzzy logic rules to process frequency variations and produce a capacitive signature of detected objects.

In a particularly advantageous production method for a sensor device according to the invention, the capacitive sensor modules and the electronic processing means are included in a resin. This guarantees perfect watertightness and total immunity from any mechanical or chemical attack.

According to another aspect of the invention, a system is proposed for the remote collection of data emitted by sensor devices according to the invention located in a set of storage compartments, comprising:

- at the level of each storage compartment, means for transmitting over a communications network the sensor data emitted by each sensor device,
- means for collecting the data transmitted over the communications network, and
- at the level of a central management site, means for processing the collected data.

The communications network used for the transmission of the sensor data can be the electricity network, in which case the data is transmitted using carrier current technology, a telephone network or also a radio network with or without a coaxial medium. This transmission method is particularly advantageous and economical as it requires no additional wiring.

The sensor devices and the remote collection system according to the invention can advantageously be applied to the remote management of minibars within a hotel.

An electronic box can also be envisaged behind each minibar, managing all operations for that minibar, in particular the transmission of sensor data and the monitoring of the door of the minibar. In particular, an electromagnetic lock can be envisaged for each minibar, allowing the opening and closing of the door to be monitored.

BRIEF DESCRIPTION OF THE DRAWINGS

Other features and advantages of the invention will appear further in the description below. In the annexed drawings provided as non limitative examples:

FIG. 1A shows a sensor device according to the invention, in the form of a tray;

FIG. 1B shows a specific form of design of a capacitive module;

FIG. 1C illustrates the case of an object to be sensed which is displaced with respect to the center of a capacitive module;

DESCRIPTION OF THE PREFERRED EMBODIMENTS

Figure 2:
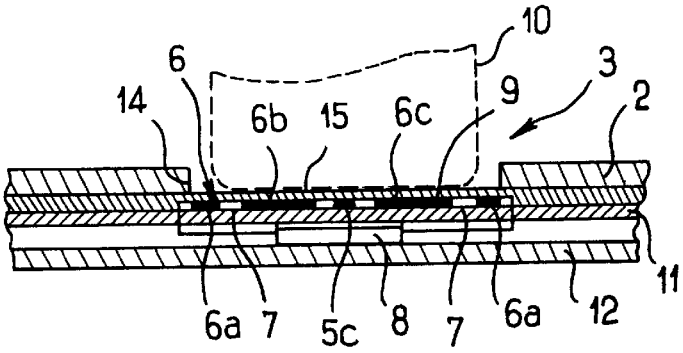
FIG. 2 is a cross section view of a first form of implementation of a capacitive module associated with a hollowed support.

There follows a description of examples of implementation of a sensor device according to the invention, with reference to the aforementioned figures. In the description which follows, similar elements in the different examples of implementation have identical references.

In a first example of the implementation of a sensor device according to the invention, the sensor device 1 takes the form of a tray containing for example ten capacitive sensor modules 3 and containing a processing electronics set, as illustrated by FIG. 1A. This tray has outer dimensions allowing it to be inserted in a standard minibar by substituting it for a shelf.

The sensor device 1 comprises, with reference to FIG. 1, an upper surface 2, made for example of epoxy, containing circular recesses 14 the bottoms 15 of which are intended to house the bases of bottles, cans and miniatures. The capacitive modules 3, each equipped with a pair of electrodes 5, 6 separated by an inter-electrode space 7, are arranged at the bottom of the recesses 14.

The electronic oscillation and processing circuits are incorporated within the tray, which is equipped with a connector 4 preferably arranged at the level of a rear edge 16 of the tray. It can alternatively be envisaged to fit the tray with a wire output provided at the end of a connector.

As a non-limitative example, each capacitive module may have the structure shown in FIG. 1B. A first electrode or armature 6 is constituted by an external conductive circular ring 6*a* and by two conductive angular sectors 6*b*, 6*c* located inside the ring 6*a* and electrically linked to it by conductive bridges 6*d*, 6*e*. The second electrode or armature 5 is constituted by two other conductive angular sectors 5*a*, 5*b* located inside the ring 6*a* and electrically linked to each other by a conductive bridge 5*c*. The ring 6*a* and the four angular sectors 6*b*, 6*c*; 5*a*, 5*b* are separated from each other by an insulating inter-electrode space 7. This particular geometry has allowed the obtention of an approximately linear and limited variation of capacitance as a function of the movement of an object 10 with respect to a central position on the capacitive module 3, when a situation is encountered such as that illustrated by FIG. 1C. The fact of being able to obtain an approximately linear variation in detected capacitance is essential to allow satisfactory and reproducible identification of a sensed object. Furthermore, with the proposed geometry, symmetrization of the capacitive module is obtained as the measured capacitance no longer depends on the relative angular position of the object with respect to the module.

Moreover, numerous geometrical variants can be envisaged, in particular with a number of conductive sectors greater than 4 or a shape which is not circular, for example elliptical or any other shape.

A very simple method for implementing a capacitive module having the aforementioned geometry consists in engraving a printed circuit either by a chemical process or by milling.

In the first form of implementation illustrated by FIG. 2 which is a cross section view along AA of the tray shown in FIG. 1, the sensor device 1 comprises, below the upper surface 2, a non-conductive protective film 9, very thin electrodes 5, 6 separated by a dielectric inter-electrode space 7, an insulating support plate 11 on the upper surface of which are arranged the pairs of electrodes 5, 6 and on the inner surface of which are placed oscillation electronic circuits 8 associated with each capacitive sensor module 3, and a lower plate 12, also made of epoxy. The electrodes 5, 6 preferably have a geometry providing a linear variation of the capacitance detected in the event that an object is moved, and are separated by the insulating inter-electrode space 7. The cross section view thus shows the external conductive ring 6*a* and the two angular sectors 6*b*, 6*c* of the first electrode 6, the conductive bridge 5*c* which connects the two angular sectors (not shown) of the second electrode 5, and sections of the inter-electrode space 7.

Figure 3:
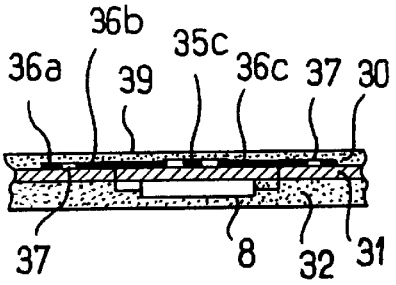
FIG. 3 is a cross section view of a second form of implementation of a capacitive module contained in a resin.

In another form of implementation illustrated in FIG. 3, the electrodes, the circuit support plate 31 and the electronic circuits 8 are contained in a resin 32 in such a manner that a thin insulating layer separates the upper surface 39 of the capacitive sensor module from the two electrodes 35, 36. The cross section view in FIG. 3 only shows the external ring 36*a* and the two angular sectors 36*b*, 36*c* of the first electrode 36, the conductive bridge 35*c* connecting the two angular sectors (not shown) of the second electrode, and several sections of the inter-electrode space 37.

Figure 4:
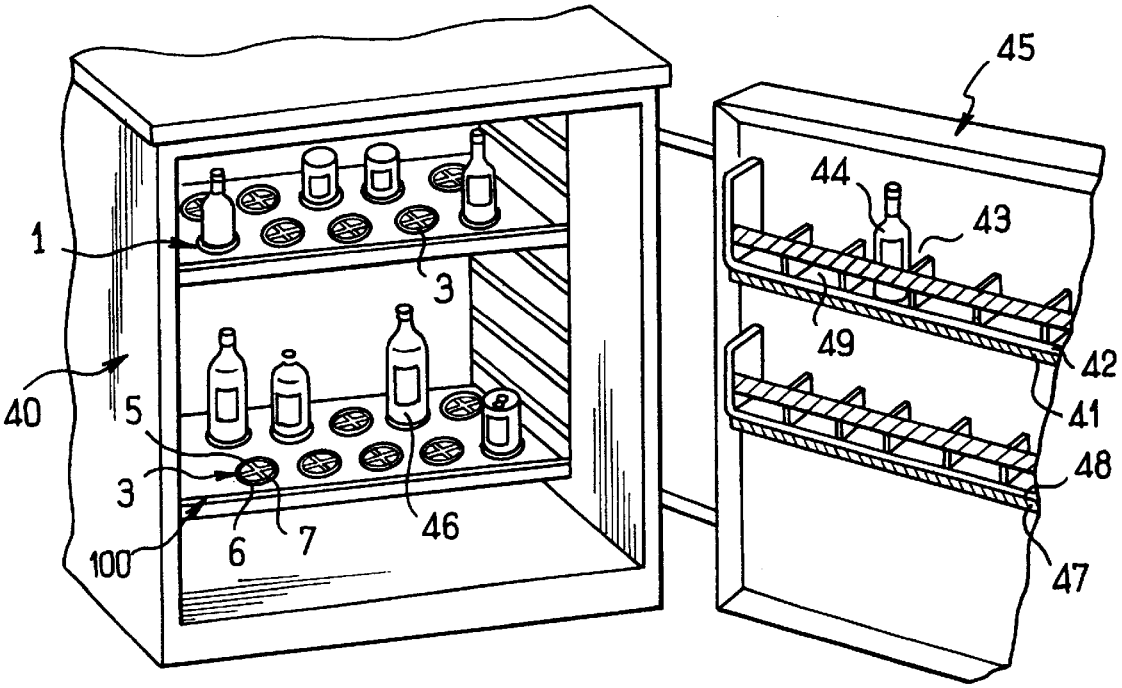
FIG. 4 is a partial section view of a minibar equipped with sensor devices according to the invention.

The electronic trays 1, 100 such as those just described are particularly suitable for insertion in a minibar 40 in the place of the usual shelves, as illustrated in FIG. 4. Sensor devices 41, 47 according to the invention can also be envisaged, designed to be placed against the lower surface of object holders 42, 48 existing in the internal surface of the door 45 of the minibar 40. These object holders are generally divided into several compartments 43, 49 housing objects 44, for example miniatures. The sensors 41, 47 contain the same number of capacitive modules as compartments.

Figure 5:
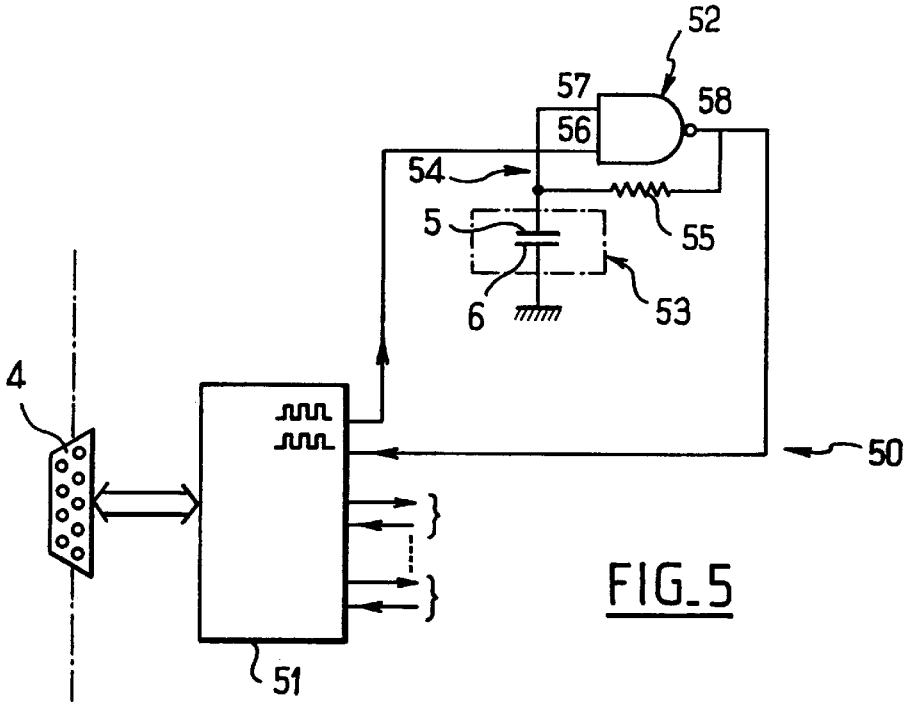
FIG. 5 is a simplified diagram of an electronic processing unit associated with a capacitive module.

The oscillation and processing electronics 50 contained in a sensor device according to the invention can be designed in numerous ways, implementing techniques well known to a person skilled in the art. Very simple technical solutions will be preferred as only all or nothing sensing is involved rather than measurements of capacitance. As a non-limitative example shown in FIG. 5, the oscillation electronics 54 can be based on a dual input NAND gate 52: a first input 56 receives an oscillation signal originating from a processing circuit 51 common to all the capacitive modules of a tray; the second input is connected on the one hand to the output 58 of the NAND logic gate 52 via a resistance 55 and on the other hand to one 5 of the two electrodes of the capacitive module, the other electrode 6 being earthed. The capacitance 53 between the two electrodes 5, 6 is thus contained in an oscillating circuit the oscillation frequency of which will depend on the value of the capacitance, which varies depending on the presence or absence of an object adjacent to the inter-electrode space.

As an experimental example observed on a capacitive sensor module, there can be observed an oscillation frequency of the order of 1.4 MHz in the absence of an object, while the oscillation frequency drops to approximately 0.4 MHz in the presence of an aluminum can on the capacitive module. The capacitances measured may vary for example from 4 pF to 16 pF and the frequencies from 1 MHz to 60 kHz. The processing circuit 51, which can advantageously be implemented in the form of an ASIC circuit optionally protected against copying, receives the output signals of each oscillating circuit associated with each module, provides detection of any variation in the oscillation frequency as well as the transmission of sensor data to outside the tray via the connector 4 to a central processing site.

The processing circuit can advantageously contain a microprocessor system programmed to apply the fundamental rules of fuzzy logic. In particular, this allows the control of parasitic perturbations such as condensation on the capacitive modules or handling by the operator.

Figure 6:
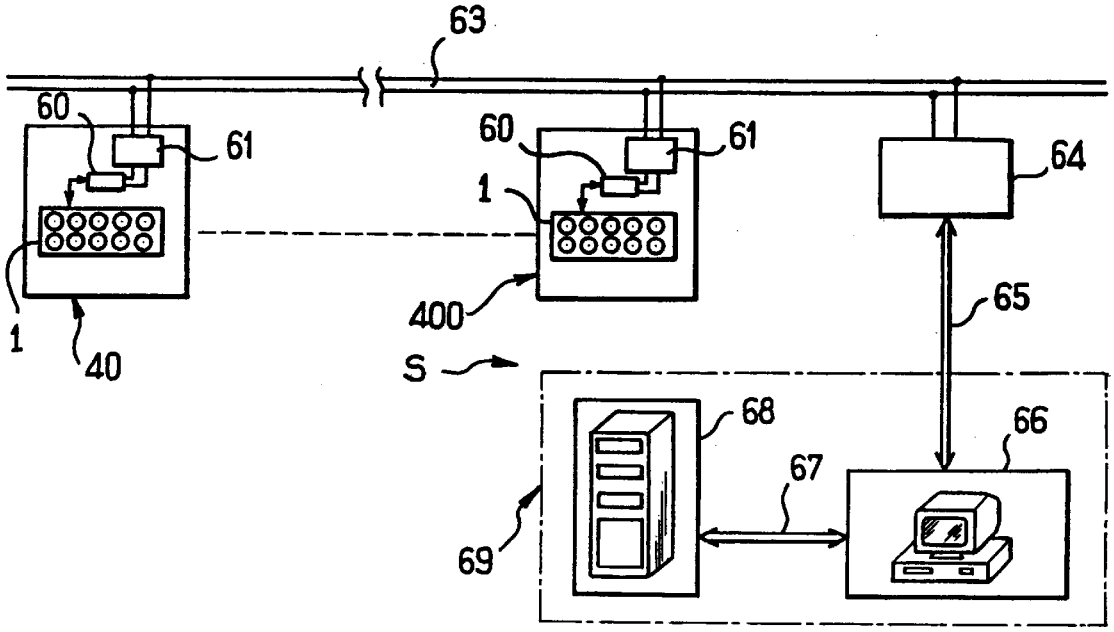
FIG. 6 is a block diagram of a remote collection system according to the invention.

Data transmission can be carried out in several ways within a remote data collection system. For example, a particularly advantageous implementation method consists in using the hotel's mains electricity circuit, using standard transmission techniques by carrier currents, as illustrated in FIG. 6 showing a remote collection system S. Each minibar 40, 400 contains an electronic device 60 to input the sensor data into the electricity network 63 in the form of carrier currents at the level of power supply module 61 of said minibar. A centralizing device 64 is envisaged for a group of rooms with a view to receiving and collecting sensor data inputted into the electricity network 63, and transmitting this collected data via a serial link 65, for example a 4-wire link of RS422 type, to a minibar system management station 66, for example a microcomputer, on a central management site 69 comprising the hotel's management computer means 68. The minibar management station 66 is preferably connected to the management computer means 68 with a view to exchanging useful information, such as recording, consumption, invoicing information, etc.

However, there can also be envisaged other transmission methods than the carrier current transmission method just described. The hotel's internal telephone network can for example be used, or a cable network, for example an internal multimedia network. A radio network with or without a coaxial medium can also be used, and in general any type of communications network.

Whatever the transmission method used, when a client removes a product from the minibar, the corresponding sensor device issues an absence sensing signal which is transmitted to the operating station. Invoicing occurs in two situations: after the door is closed, or after a time lapse which is determined by the hotel operator. When the client replaces the product without closing the door within that time lapse, no invoicing occurs.

Of course, the invention is not limited to the examples just described and numerous adjustments can be made to these examples without exceeding the scope of the invention. Thus, the structure of the sensor devices according to the invention varies as a function of the shape and internal organization of the minibars. The materials constituting these sensor devices can also vary according to the operating conditions and cost considerations. The oscillation and processing circuitry can be designed in many other ways without exceeding the scope of the present invention. The geometry of the capacitive module electrodes can also be modified as a function of specific constraints linked to the nature of the objects to be sensed.

What is claimed is:

1. Device (1, 100) for sensing the presence of an object in a storage compartment (40, 400) comprising a set of capacitive sensor modules (3) each comprising two electrodes (5, 6; 75, 76) located close to a support (9, 39, 42) intended to house an object (10, 44) and an oscillating circuit (54) including a capacitance (53, 70) between the two electrodes (5, 6; 75, 76), and electronic processing means (51) cooperating with each said capacitive sensor module to emit sensor signals indicating the presence or absence of objects on each of the said supports (9, 39, 42), wherein the electronic processing means (51) also cooperates with each capacitive sensor module in order to supply a capacitive signature of the objects present in the storage compartment, this capacitive signature comprising information indicating a modification of the geometric and/or volumetric characteristics of said object.

2. Sensor device (1) according to claim 1, characterized in that the capacitive signature of an object present in the storage compartment includes information indicating a modification of said object's geometric and/or volumetric characteristics.

3. Sensor device (1) according to one of claims 1 or 2, characterized in that the two electrodes (5, 6) of each capacitive sensor module (3) have a geometry designed to keep a limited and substantially linear variation of the capacitance detected when an object is moved on said capacitive sensor module.

4. Sensor device (1) according to claim 3, characterized in that each capacitive sensor module (3) comprises:

a first electrode (6) comprising an external conductive ring **(6*a*) and, inside this ring (6*a*), at least a first and a third conductive internal sector (6*b*, 6*c*) connected electrically to said external conductive ring (6*a*), and a second electrode (5) comprising, inside said external conductive ring (6*a*), a second and fourth conductive internal sector (5*a*, 5*b*)** electrically connected to each other.

5. Sensor device (1) according to claim 1, characterized in that the capacitive sensor modules (3) and the electronic processing means (51) ar e included in a watertight structure (13) comp rising connection means (4) intended for cooperation with external connection means for the purpose of transmitting the sensor signals.

6. Sensor device (1) according to claim 1, characterized in that it further comprises on its upper surface (2) recesses (14) as supports for housing objects.

7. Sensor device (1) according to claim 6, characterized in that a thin insulating layer (9) is arranged between the electrodes (5, 6) and the bottom (15) of the recesses (14).

8. Sensor device (1) according to claim 6, characterized in that these recesses (14) are of a substantially cylindrical shape.

9. Sensor device (1, 100) according to claim 1, characterized in that it is arranged in the form of a removable watertight tray intended to be inserted in the place of a shelf in a refrigerator, in particular a minibar (40).

10. Sensor device (1) according to claim 9, characterized in that the connection means (4) are arranged on a rear portion (16) of this tray in such a manner that, when said tray is inserted, these connection means come into contact with external connection means arranged appropriately at the back of the refrigerator.

11. Sensor device (41) according to claim 1, characterized in that it is intended to be arranged against an internal surface of a support (42) for objects containing several compartments (45), each capacitive sensor module being associated with one of the compartments (45).

12. Sensor device according to claim 1, characterized in that its upper surface (39) is arranged to serve as an object holder, with an insulating layer (30) provided between the electrodes (35, 36) and said upper surface (39).

13. Sensor device (1) according to claim 1, characterized in that the electronic processing means (50) comprise an ASIC circuit (51).

14. Sensor device according to claim 1, characterized in that the electronic processing means are arranged to apply fuzzy logic rules to process frequency variations and to produce a capacitive signature of detected objects.

15. Sensor device according to claim 1, characterized in that the capacitive sensor modules and the electronic processing means are included in a resin.

16. System (S) for the remote collection of data emitted by sensor devices (1) according to claim 1 located in a set of storage compartments (40, 400), comprising:

at the level of each storage compartment (40, 400) means (60) for transmitting over a communications network (63) the sensor data emitted by each sensor device (1), means (64) for collecting the data transmitted over the communications network (63), and at the level of a central management site (69), means (66) for processing the collected data.

17. Remote collection system (S) according to claim 16, characterized in that the communications network used comprises the mains electricity network (63), the data being transmitted using the carrier current technique.

18. Remote collection system according to claim 16, characterized in that the communications network used comprises a telephone network.

19. Remote collection system according to claim 16, characterized in that the communications network used comprises a radio network.

20. Use of the sensor devices and the remote collection system according to claim 1 for the remote management of minibars in a hotel.

21. A device for sensing objects in a storage compartment comprising:

a plurality of capacitive sensor modules, each said sensor module comprising:

a recess adapted to receive an object;

two electrodes disposed within the recess so that the object when placed in the recess will contact the two electrodes; and an oscillation circuit electrically connected to the two electrodes so that a capacitance across the two electrodes influences operation of the oscillation circuit; and an electronic processing means electrically connected to the oscillation circuit of each said capacitive sensor module to provide a signal based on a capacitive behavior of the object in contact with the electrodes.

22. The device of claim 21, wherein the capacitive behavior of the object includes the steady state value of the capacitance of the object in the oscillation circuit when the object is in contact with the electrodes.

23. The device of claim 22, wherein the capacitive behavior of the object further includes a variation in capacitance of the object in the oscillation circuit over time as the object is removed from or placed in contact with the electrodes.

24. The device of claim 23, wherein said two electrodes comprise:

a first electrode comprising an external conductive ring and, inside said ring, at least a first and a third conductive internal sector connected electrically to said external conductive ring; and a second electrode comprising, inside said external conductive ring, a second and fourth conductive internal sector electrically connected to each other.

* * * * *